United States Patent [19]

Weinstein

[11] 4,398,633

[45] Aug. 16, 1983

[54] PACKAGE FOR ICE CREAM CONES

[75] Inventor: David Weinstein, Baltimore, Md.

[73] Assignee: David Weinstein, Owings Mills, Md.

[21] Appl. No.: 291,951

[22] Filed: Aug. 11, 1981

[51] Int. Cl.[3] ..... B65D 85/62; B65D 21/06

[52] U.S. Cl. ..... 206/499; 206/436

[58] Field of Search ..... 206/499, 422, 436; 217/3 R, 3 FC; 229/1.5 B, 43; 426/124, 130

[56] References Cited

U.S. PATENT DOCUMENTS

| | | | |
|---|---|---|---|
| 2,142,567 | 1/1939 | Levy | 206/499 |
| 2,154,985 | 4/1939 | Lower | 217/3 FC |
| 3,240,331 | 3/1966 | Weinstein | 206/499 |
| 3,343,671 | 9/1967 | Weinstein | 220/441 |
| 3,710,931 | 1/1973 | Hollinger | 426/124 |
| 3,955,006 | 5/1976 | Sokolsky et al. | 426/396 X |

*Primary Examiner*—William T. Dixson, Jr.
*Assistant Examiner*—Brenda J. Ehrhardt
*Attorney, Agent, or Firm*—Birch, Stewart, Kolasch & Birch

[57] ABSTRACT

A package for a plurality of unfilled ice cream cones is fabricated from a conventional frustoconical tub, an insertable annular stand and a ported keeper disk resting on the stand for holding interspersed inverted and right-side-up stacks of nested ice cream cones. The array of cone stacks is preferably an upright center stack surrounded by alternated inverted and upright stacks. The upright stacks are cushioned from one another at the upper ends thereof and the inverted stacks are canted outward by the keeper disk to make room for the upright stacks. A heat sealable cover and overlying lid are provided to complete the package.

12 Claims, 3 Drawing Figures

PACKAGE FOR ICE CREAM CONES

FIELD OF THE INVENTION

This invention relates to packages and more particularly, to bulk packages for a multiplicity of unfilled ice cream cones.

BACKGROUND OF THE INVENTION

Bulk packaging for unfilled ice cream cones for other than institutional use has utilized such devices as conventional cardboard boxes or the like in which various flap configurations or internally secured bags or receptacles are utilized to receive and immobilize stacks of nested ice cream cones. U.S. Pat. No. 3,343,671 for Containers for Fragile Articles issued Sept. 26, 1967 to David Wienstein and 3,240,331 for Package for Fragile Articles issued Mar. 15, 1966 to David Weinstein are exemplary of such prior art bulk cone containers.

These prior art configurations require the use of unique structure of both the container and the internal means for immobilizing the stacks of nested and fragile unfilled ice cream cones. Thus, there is a need in the art for a simplistic bulk package for ice cream cones and other similar fragile articles which can be fabricated from conventional and readily available packaging components.

It is an object of the present invention to provide a new and novel bulk package for unfilled ice cream cones and the like.

It is another object of the present invention to provide a new and novel bulk package for unfilled ice cream cones and the like utilizing conventional frustoconical tub and skirted lid configurations.

Still another object of the present invention is to provide a new and novel bulk package for unfilled ice cream cones and the like from conventional frustoconical tub and cooperating lid structures in which the frustoconical tub can be heat sealed for santiary purposes without adhering the lid thereto.

These and other objects of the present invention will become more fully apparent with reference to the following specification and drawings which relate to a preferred embodiment of the invention.

SUMMARY OF THE INVENTION

A bulk package for unfilled ice cream cones is provided by utilizing a standard type frustoconical tub structure, such as a one-half gallon container suitable for vending fried chicken or the like into which a split collar is inserted to form an annular internal support ledge between the closed bottom and open top of the container. A plurality of stacks of nested unfilled ice cream cones are placed with their large ends down resting on the bottom of the container with the apices thereof extending upward and above the annular support ledge formed by the split ring or stand which has previously been inserted into the bottom of the frustoconical tub.

A circular keeper disk of substantially identical diameter as the annular support ledge and bearing on the order of nine symetrically arranged circular ports therein is provided to fit over the upstanding apices of the inserted inverted cone stacks, such as, for example, four stacks with four apices to thereby secure the said stacks of inverted cones from lateral movement within the container. The disk further tends to preclude movement of those inverted stacks in a vertical direction by engagement with the exterior wall portions of the uppermost inverted cones in the stacks with the edges of the circular ports through which the cones project.

Thus, the dimensions of the cone and the taper thereof and the number of cones in the stack determine the vertical extent of the split ring or stand forming the annular support ledge such that when the ported keeper disk is placed on that support ledge it will gently engage, about the periphery of those ports receiving the apex of respective ones of said inverted cones, the external surfaces of those cones.

Next, a like number of stacks of nested cones are placed apex downward into the remaining ports about the periphery of the keeper disk such that for every other port there is a right-side-up stack and intermediate these ports extend the apices of an inverted stack. This, in a symmetrical nine port array in the keeper disk provides a center port for receiving one additional stack of nested cones apexed downward as the last cones to be placed in the bulk package. A protector ring sized to engulf the open mouth of the center-most cone stack is provided to prevent the uppermost cones in the right-side-up cone stacks from directly engaging and damaging one another.

The next element of the bulk cone package of the present invention is a heat sealable paper disk or the like which is placed over the open mouth of the frustoconical tub and sealed about the top curl thereof.

The package is completed by placing a skirted lid over the sealing disk and top curl of the tub.

In an alternate embodiment of the invention, the heat sealing disk can be placed within the skirted lid as a liner to provide a fabrication module which can be placed on the top curl of the container to bring the heat sealing disk therein into proximity with that top curl and with the lid in situ, the heat sealing disk can be sealed to the container utilizing ultrasonics, induction heating or the like.

The heat sealable, moisture resistant, sealing disk may be foil, foil laminate, a polymer or a polymerlaminate, waxed paper or any combination of such moisture resistant materials having a heat sealable surface characteristic.

DETAILED DESCRIPTION OF THE DRAWINGS

Figure 1:
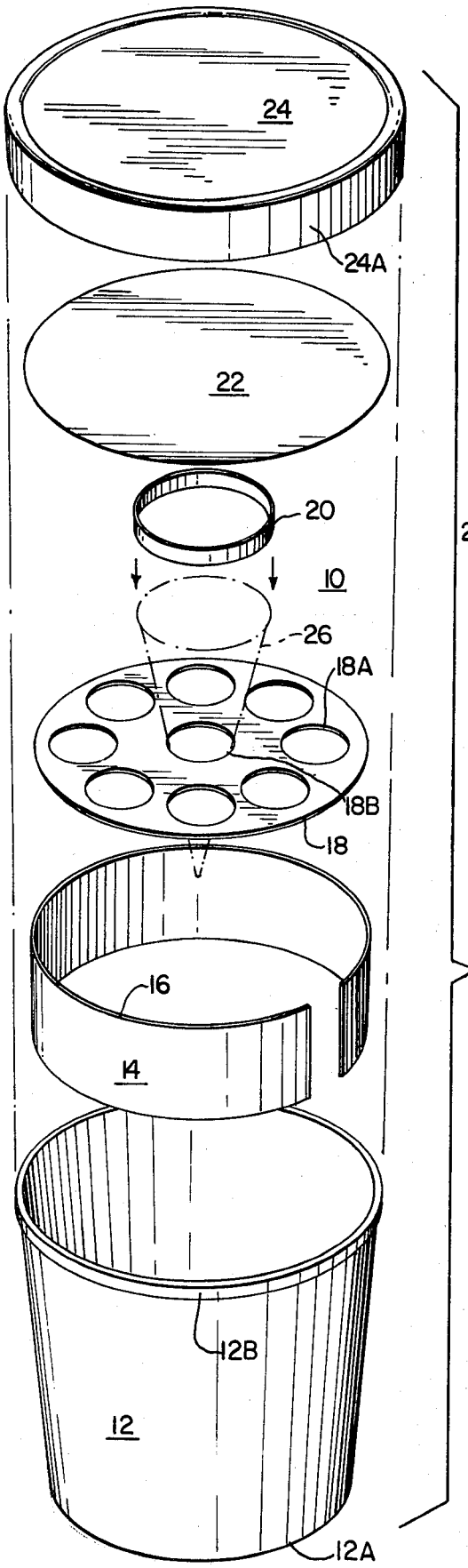
FIG. 1 is an exploded view of the bulk cone package of the present invention illustrating schematically the presence of an ice cream cone therein.

Referring in detail to the drawings and with particular reference to FIG. 1, an exploded view of the bulk cone package 10 of the present invention is illustrated as including a frustoconical tub 12 and a split ring stand 14 for the purpose of defining an annular ledge 16 about the interior of the tube 12, the said ledge 16 acting as a support for a keeper disk 18 intermediate the bottom and top edges 12A and 12B, respectively, of the said frustoconical tub 12.

The components of the bulk package 10 of the present invention are completed by means of a cushioning collar 20, a sealing disk 22, which is adapted to be heat sealed about the upper rim 12B of the frustoconical tub 12 and a skirted lid 24 having a dependent skirt 24A about the outer periphery thereof. An unfilled ice cream cone 26 is shown in phantom lines in the central port 18B of the keeper disk 18 which has an additional number of circular outer ports 18A provided therein such that an even number of the outer ports 18A, preferably, surrounds the central port 18B in a circular array.

Figure 2:
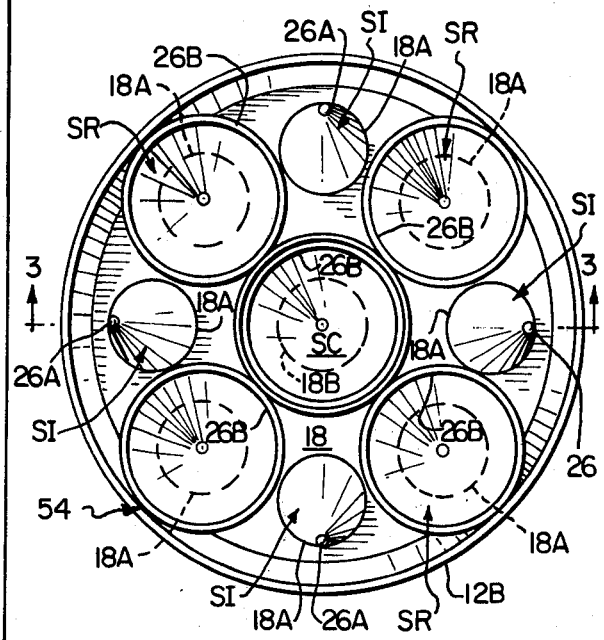
FIG. 2 is a top plan view of the bulk cone package of the present invention illustrating the presence of a complete package of ice cream cones.
Figure 3:
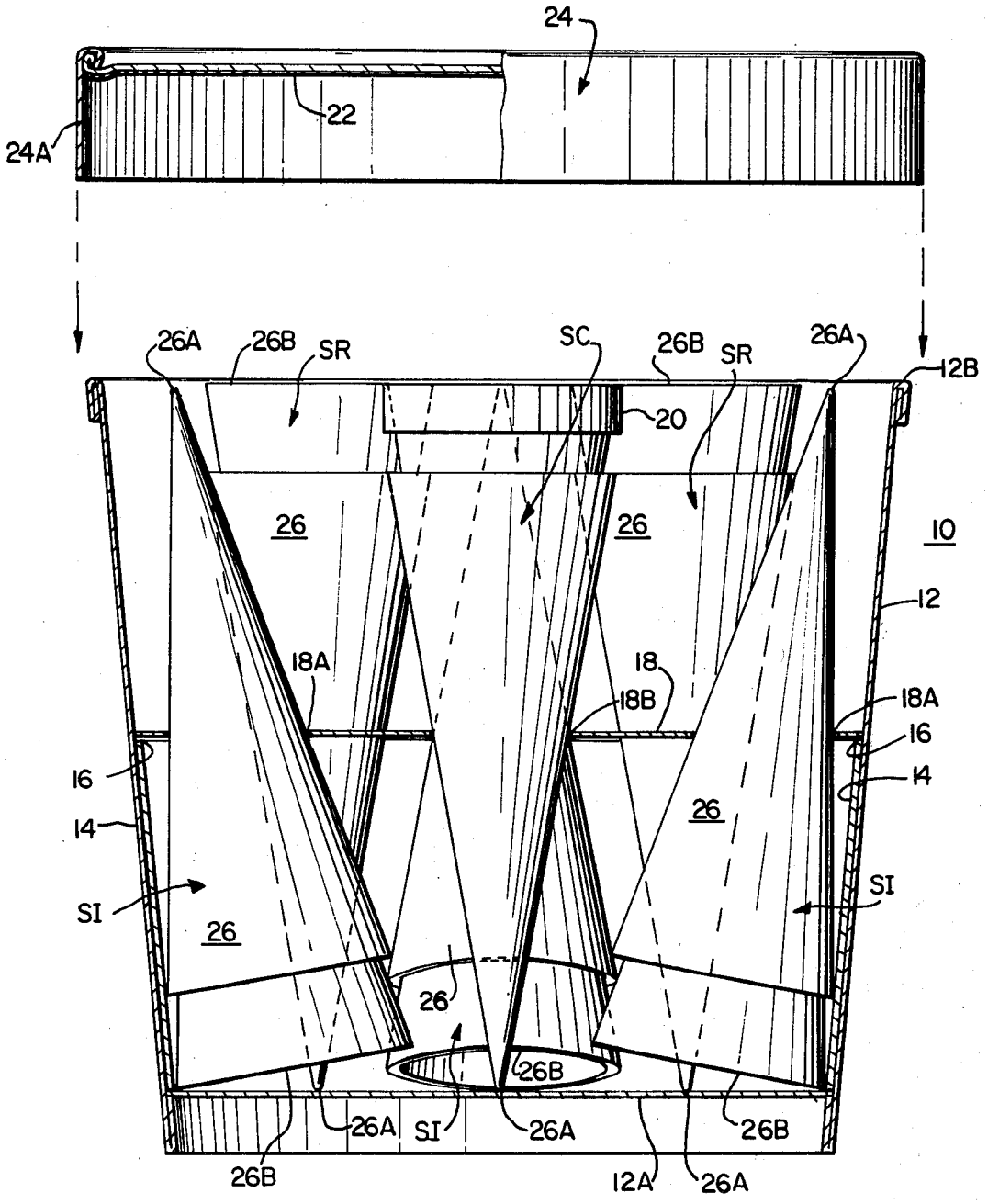
FIG. 3 is a cross-section taken along line 3—3 of FIG. 2 illustrating the filled condition of the ice cream cone bulk package of the present invention.

Referring now to FIGS. 2 and 3, it can be seen that a plurality of inverted stacks SI of unfilled ice cream cones 26 with the lowermost cones having their open mouth portions 26B engaged with the bottom 12A of the tub 12 are positioned to extend upward through alternate ones of the outer ports 18A in the keeper disk 18 to a position in which the apices 26A of the uppermost cones 26 are immediately beneath the upper rim (top curl) 12B of the tub 12.

The inverted cone stacks SI are complimented by a like number of right-side-up cone stacks SR having their open mouth ends 26B positioned immediately beneath the top curl 12B of the tub 12 with the apices 26A of the lowermost cone 26 in the right-side-up stacks SR engaging the bottom surface 12A of the tub 12. This engagement is minimal, however, due to the motion limiting engagement of the cones 26 with the peripheries of the ports 18A in the keeper disk 18 as illustrated in FIG. 3.

The last cone stack to be placed within the package 10 is the center stack SC which has the apex 26A of the lowermost cone therein in engagement with the bottom surface 12A of the tub 12 at the center point thereof as illustrated in FIG. 3. The top plan view of the multiplicity of stacks, nine (9) in number in the preferred embodiment shown, is clearly illustrated in FIG. 2. The cone stacking and cushioning assembly, except for the lid 24 and the sealing foil or disk 22 is completed by the placement of the cushioning collar 20 about the mouth 26B of the uppermost cone in the center stack SC such that all of the other open mouth edges 26B of the cones in the right side up stacks SR are mutually cushioned by the collar 20 from damaging themselves against the open mouth 26B of the center stack SC.

Also, as can be seen from FIG. 3, the action of the keeper disk 18 is to cant the inverted stacks SI of ice cream cones 26 such that there is adequate room for the right-side-up stacks SR and center stack SC above the keeper disk 18. In other words, the entire array of stacked cones defined by the inverted stacks SI, right-side-up stacks SR and center stack SC is better conformed to a frustoconical tub configuration by the action of the keeper disk 18. Also, as can be seen in FIG. 3, the keeper disk 18 rests on the annular ledge 16 provided by the split ring stand 14, the latter resting on the bottom 12A of the frustoconical tub 12.

In operation, after the inverted stacks SI have been placed in tub 12 and the keeper disk 18 fitted thereover, the right-side-up stacks SR and the center stack SC are placed in position. Thereafter the cushioning collar 20 is placed about the open mouth 26B of the uppermost cone 26 in the center stack SC and the lid 24 and sealing disk 22 are placed over the top curl 12B of the tub 12. The heat sealable disk 22 is then sealed to the top curl 12B by any suitable means known in the art.

As previously described, the sealing disk 22 may be contained within the lid 24 as illustrated in FIG. 3 and heat applied to it through the thickness of the lid 24 or by ultrasonics or some other suitable heating method. Of course, the heat sealing disk 22 may be placed over the top curl 12B of the tub 12 and ironed thereto by other conventional heat sealing methods prior to the application of the lid 24 to the tub 12 to complete the package 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Package means for holding a plurality of unfilled ice cream cones comprising:

frustoconical tub means having a closed bottom surface, an open top defined by an annular rim and a frustoconical sidewall;

stand means insertable into said tub means and providing a support about the interior of the sidewall thereof;

keeper means supported by said stand means for positioning said ice cream cones, said keeper means defining a substantially planar array of circular port means therein comprising a center port means and a circular array of outer port means generally concentric with said sidewall;

said center port means and alternate ones of said outer port means receiving at least one unfilled ice cream cone each, with the apices of the said ice cream cones positioned adjacent the said bottom surface of said tub means and the remaining ones of said outer port means receiving at least one inverted unfilled ice cream cone each with the apices thereof adjacent said top rim and to constrain said inverted cones in an outwardly canted posture; and lid means overlying said annular rim of said tub means.

2. The package means of claim 1, which further includes cushioning means disposed adjacent said lid means for mutually engaging the open ends of those of said unfilled ice cream cones positioned with apices adjacent said bottom surface of said tub means.

3. The package means of claim 2, wherein said cushioning means comprises an annular ring of compressible material encircling the open end of said unfilled ice cream cones in said center port means.

4. The package means of either of claims 1, 2 or 3, wherein said lid means comprises heat sealable cover means for heat sealed attachment to said annular rim of said tub means and a removable closure means overlying said cover means.

5. The package means of either of claims 1, 2, or 3, wherein said stand means comprises a split ring mutually engageable with said bottom surface and the interior of said sidewall.

6. The package means of either of claims 1, 2 or 3, wherein said keeper means comprises a circular disk.

7. The package means of either of claims 1, 2, or 3, wherein said stand means comprises a split ring mutually engageable with said bottom surface and the interior of said sidewall; and wherein said keeper means comprises a circular disk.

8. The package means of either of claims 1, 2 or 3, wherein said lid means comprises heat sealable cover means for heat sealed attachment to said annular rim of said tub means and a removable closure means overlying said cover means; and wherein said stand means comprises a split ring mutually engageable with said bottom surface and the interior of said sidewall.

9. The package means of either of claims 1, 2 or 3 wherein said lid means comprises heat sealable cover means for heat sealed attachment to said annular rim of said tub means and a removable closure overlying said cover means; and wherein said keeper means comprises a circular disk.

10. The package means of either of claims 1, 2 or 3, wherein said lid means comprises heat sealable cover means for heat sealed attachment to said annular rim of said tub means and a removable closure means overlying said cover means;

wherein said stand means comprises a split ring mutually engageable with said bottom surface and the interior of said sidewall; and wherein said keeper means comprises a circular disk.

11. A packaged ice cream cone assembly comprising:

frustoconical tub means having a closed bottom surface, an open top defined by an annular rim and a frustoconical sidewall;

stand means insertable into said tub means and providing a support about the interior of the sidewall thereof;

keeper means supported by said stand means for positioning said ice cream cones, said keeper means defining a substantially planar array of circular port means therein comprising a center port means and a circular array of outer port means generally concentric with said sidewall;

a plurality of ice cream cones, at least one positioned in each of said circular port means, the apices of said ice cream cones positioned in said center port means and alternate ones of said outer port means being located adjacent the said bottom surface of said tub means, the apices of said ice cream cones positioned in the remaining ones of said outer port means being located adjacent said top rim and being constrained by their associated said port means in an outwardly canted posture; and lid means overlying said annular rim of said tub means.

12. A packaging assembly using a frustoconical tub for holding a plurality of unfilled ice cream cones comprising:

frustoconical tub means having a closed bottom surface, an open top defined by an annular rim and a frustoconical sidewall;

stand means insertable into said tub means and providing a support about the interior of the sidewall thereof;

keeper means supported by said stand means for positioning said ice cream cone said keeper means defining a substantially planar array of circular port means therein comprising a center port means and a circular array of outer port means generally concentric with said sidewall;

said center port means and alternate ones of said outer port means receiving at least one unfilled ice cream cone each, with the apices of the said ice cream cones positioned adjacent the said bottom surface of said tub means and the remaining ones of said outer port means receiving at least one inverted unfilled ice cream cone each with the apices thereof adjacent said top rim and to constrain said inverted cones in an outwardly canted posture; and lid means overlying said annular rim of said tub means.

* * * * *

UNITED STATES PATENT AND TRADEMARK OFFICE

CERTIFICATE OF CORRECTION

PATENT NO. : 4,398,633

DATED : August 16, 1983

INVENTOR(S) : David Weinstein

It is certified that error appears in the above—identified patent and that said Letters Patent is hereby corrected as shown below:

On front page of patent, line [73], please delete "Assignee: David Weinstein, Owings Mills, Md." insert therefore, -- Assignee: MARYLAND CUP CORPORATION, Owings Mills, Md. -- .

Signed and Sealed this

*Thirteenth* Day of *December 1983*

[SEAL]

*Attest:*

GERALD J. MOSSINGHOFF

*Attesting Officer*

*Commissioner of Patents and Trademarks*